United States Patent [19]

Kelley

[11] 4,224,757

[45] Sep. 30, 1980

[54] TOY PERFUME MAKER

[75] Inventor: William J. Kelley, Torrance, Calif.

[73] Assignee: Mattel, Inc., Hawthorne, Calif.

[21] Appl. No.: 12,925

[22] Filed: Feb. 16, 1979

[51] Int. Cl.[3] ..... A63H 33/00

[52] U.S. Cl. ..... 46/1 R; 46/47; 46/14; 366/204

[58] Field of Search ..... 46/14, 39, 47, 40, 1 R; 239/34, 57, 374; 99/287, 348; 366/204, 205, 314

[56] References Cited

U.S. PATENT DOCUMENTS

| | | | |
|---|---|---|---|
| 711,923 | 10/1902 | Fales | 239/374 |
| 1,166,568 | 1/1916 | Wilton | 366/314 |
| 1,372,102 | 3/1921 | Sporer | 366/204 |
| 3,339,476 | 9/1967 | De Troya | 99/287 |

*Primary Examiner*—Robert Peshock
*Assistant Examiner*—Mickey Yu

[57] ABSTRACT

A toy perfume maker having a vial capable of containing a liquid in which perfume is to be mixed and an arrangement for suspending a perfume concentrate in the vial and rotating it. The arrangement includes a base, a cup which rotates on the upper surface of the base, a holder for perfume concentrate held and rotated by the cup, and a receptacle fixed to the base for fixedly supporting the vial within the cup.

5 Claims, 2 Drawing Figures

TOY PERFUME MAKER

BACKGROUND OF THE INVENTION

The background of the invention will be discussed in two parts:

1. Field of the Invention

This invention relates to toys and, more particularly, to a toy perfume maker.

2. Description of the Prior Art

There have been a myriad of toys developed over the years for use by children of all ages. Many of these toys have become classics and have been reproduced again and again. Those toys which have lasted have certain common characteristics. The most important of these characteristics is that they provide a substantial amount of play value for the child. The play value of a toy may be enhanced by making it exciting, by having it provide a learning experience for the child, and by other means. Providing such play value has caused a substantial problem for many prior art toys.

It is an object of the present invention to provide a new and improved toy which allows the child to learn through emulating the actions of its parents.

It is another object of the present invention to provide a new and improved toy which allows a child to feel the emotional excitement and satisfaction of making a useful product.

It is still another object of the present invention to provide a new and improved toy perfume maker.

SUMMARY OF THE INVENTION

The foregoing and other objects of the invention are accomplished by a toy perfume maker which includes a base, a vial for holding a solution which is to become perfume, a holder containing a concentrated solution of perfume to be mixed in solution, and means for suspending the holder with the concentrated perfume in the vial and rotating it therein so that the concentrated perfume is mixed into solution. In a preferred embodiment, a gear on the face of the base rotates an assembly in which the vial is held. The assembly includes means for suspending the holder of the concentrated perfume within the vial so that its rotation will be accomplished by moving the gear.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
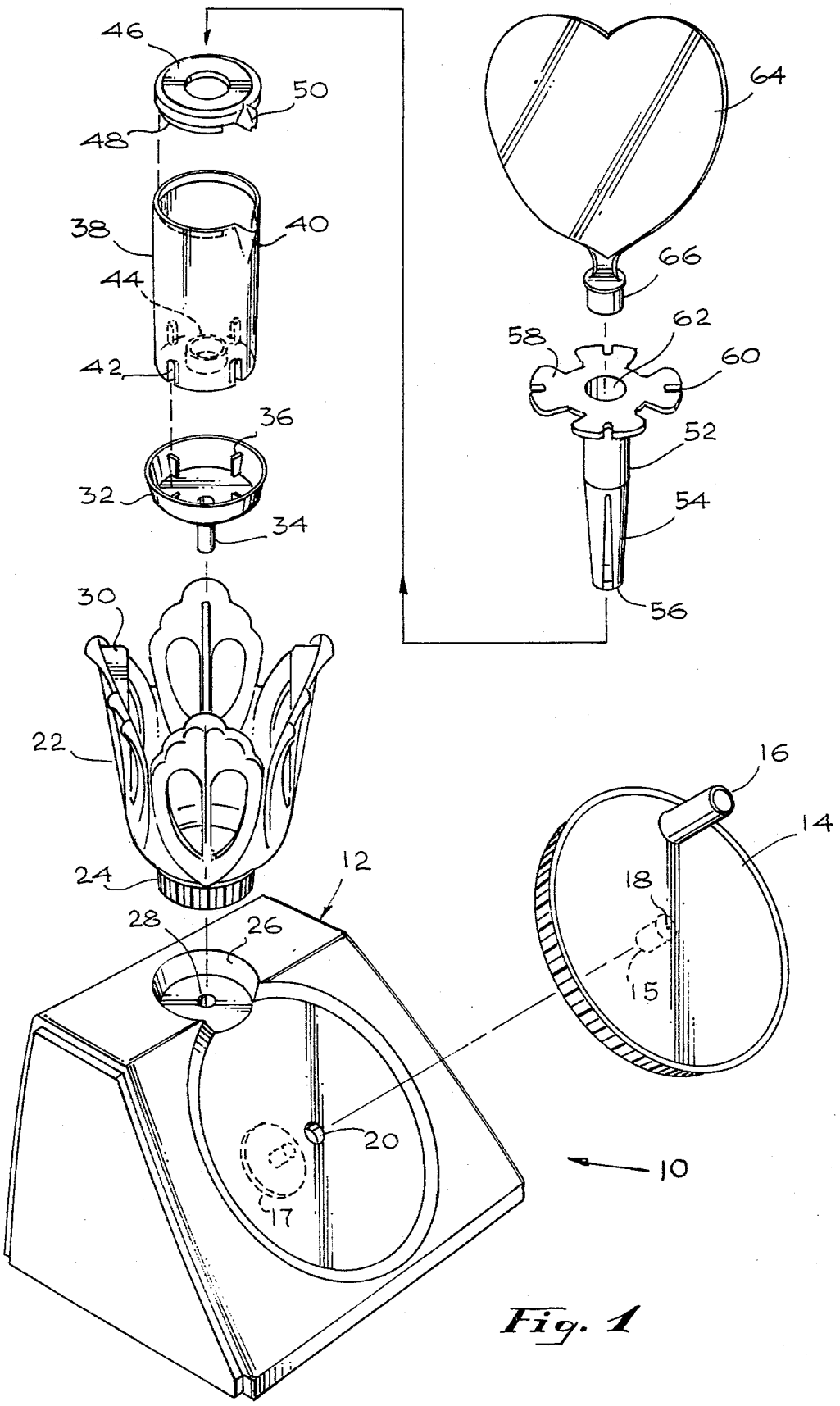
FIG. 1 is an exploded perspective view of a child's perfume maker constructed in accordance with the invention.

Referring now to the drawings and, more particularly, to FIG. 1, there is shown an exploded perspective view of a child's perfume maker 10 constructed in accordance with the invention. The perfume maker 10 includes a base 12 which is essentially a box having a slanted front surface. The base 12 is open at the bottom and has rotatably mounted thereon a gear 14 having a handle 16. The gear 14 rotates abouts its center 18 on a shaft 15 passing through an opening 20 in the front face of the base 12.

A cup 22 having a gear surface 24 around its bottom fits loosely in a recess 26 in the upper surface of the base 12. The recess 26 has an opening 28 therein which may continue into the interior of the base 12. The cup 22 has a number of projections 30 around the interior of its upper periphery the use of which will be explained hereinafter.

The cup 22 is mounted to rotate in the recess 26 of the base 12 by a receptacle 32 which has a depending cylindrical projection 34 at its lower center of such a size as to pass through a hole in the base of the cup 22 and fit tightly into the opening 28 of the base 12. The receptacle 32 which is essentially a hollow cylinder has a number of projections 36 on its inner surface which are adapted to mate with recesses 42 in base of the vial 38.

The vial 38 is a miniature container in which perfume may be mixed and held. It has a pouring spout 40 in its upper periphery and supports at its base within its interior a cup 44. The vial 38 may be covered with a cap 46 which has an edge 48 adapted to mate with the upper surface of the vial 38. The cap 46 also has a spout cover 50 which matches the spout 40 of the vial 38.

A hole in the upper surface of the cap 46 allows a perfume holder 52 to pass loosely therethrough. The holder 52 has prongs 54 which meet in a base 56 to form a hollow interior. The hollow interior carries a water soluble wax in which the concentrated perfume is embedded. The holder 52 has a flower-shaped top 58 with recesses 60 in each of the petals. These recesses 60 are adapted to mate with the projections 30 which extend into the cup 22 when the holder 52 is inserted through the cap 46 and into the vial 38. In this position, the prongs 54 of the holder 52 are held loosely with the cup 44 of the vial 38.

The holder 52 has an opening 62 in its upper surface adapted to receive a plug 66 attached to a lifter 64. The lifter 64 shown in FIG. 1 is heart-shaped and provides a large surface so that a child may withdraw the holder 52 easily from the perfume maker 10.

Figure 2:
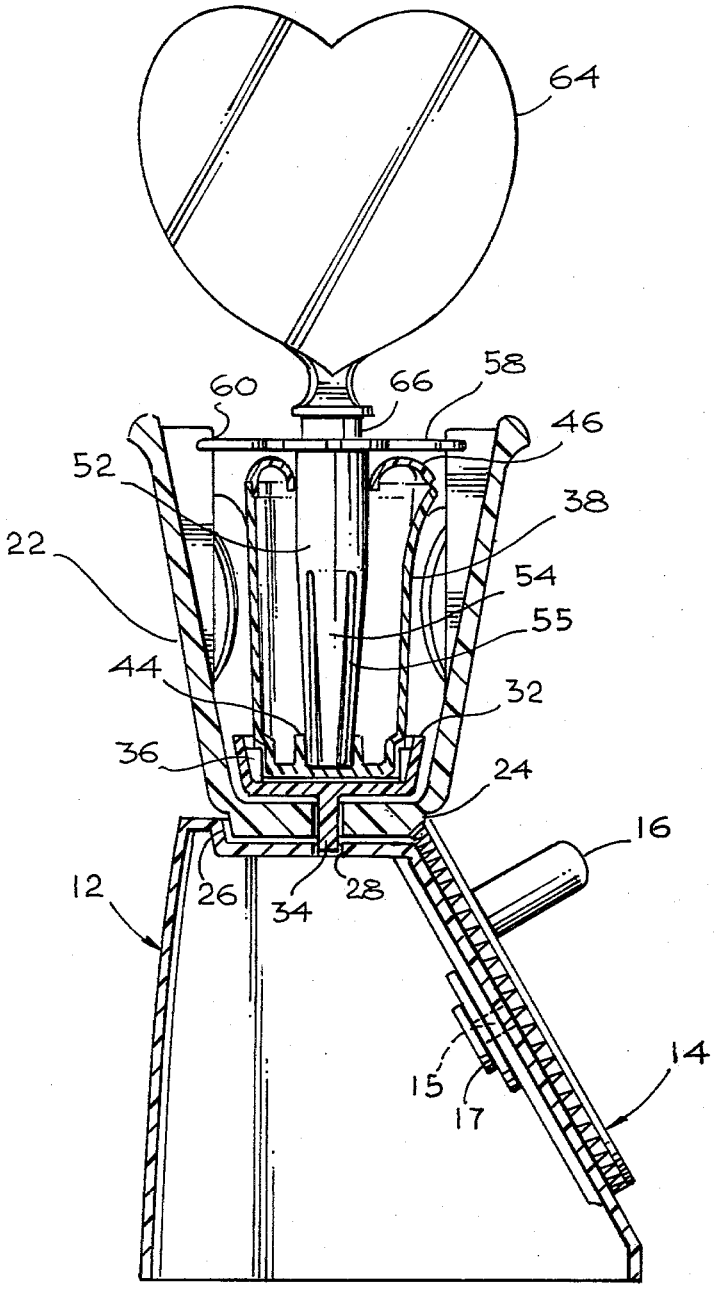
FIG. 2 is a cross-sectional view revealing the inner details of the invention shown in FIG. 1.

Referring now to FIG. 2, the invention of FIG. 1 is shown in cross-section to better explain its operation. As may be seen, the base 12 has mounted for rotation on its front sloping surface the gear 14. A shaft 15 connected to the gear 14 fits through the opening 20 and is affixed to the backside of the front wall of the base 12 by means such as a fitting 17. The fitting 17 may be a screw, a snap fitting, or other means for causing the gear 14 to rotatably adhere to the front surface of the base 12.

As may be seen in FIG. 2, the receptacle 32 has depending projection 34 tightly forced into the opening 28 in the recess 26. As may be also seen, the cup 22 has an opening in its base through which the depending projection 34 loosely fits. The gear surface of the gear 14 is adapted to mesh with the gear surface 24 at the bottom of the cup 22 so that rotation of the handle 16 (consequently of the gear 14) will rotate the cup 22.

While the cup 22 rotates, the receptacle 32 is held firmly in place and the projections 36 from the upstanding surface of the receptacle 32 mate with the recesses 42 in the base of the vial 38 so that the vial 38 is also held in a fixed position. However, the perfume holder 52 has recesses 60 in its top 58 adapted to fit the projections 30 of the cup 22 and its prongs 54 are held loosely by the cup 44 within the vial 38. Consequently, when the cup 22 rotates, the perfume holder 52 rotates with it within the fixed vial 38. The wax-like concentrate of perfume 55 contained between the prongs 54 will therefore rotate with the rotation of the cup in any solution which is within the vial 38.

In a preferred embodiment, the perfume concentrate may include a wax such as Union Carbide Carbo Wax 1540 (95 parts), Felton INT. Carnation Bouquet ×4100 (5 parts), and a dye of minuscule proportion (0.5 parts). The solution carried within the vial 38 may be water. Various other concentrated perfumes may be included within a holder 52 although for use with water they must be water soluble. It would be a matter of choice to utilize a concentrate of perfume which is not water soluble in a solution in which it is dissolvable.

In operation, a holder 52 containing a concentrated perfume is placed into the perfume maker 10 so that the prongs 54 project through the cap 46 and into the vial 38 which contains a water solution. The gear 14 is then rotated by manipulation of the handle 16 so that the cup 22 and the holder 52 rotate therewith. The wax solution will slowly dissolve in the water as the holder 52 is rotated and a bouquet will be released. After a period sufficient to mix the perfume, the child may withdraw the holder 52 from the perfume maker 10. Thereafter, the vial 38 may be withdrawn and the perfume utilized as the child desires.

In a preferred embodiment, all of the members of the perfume maker 10 are molded by well-known techniques from well-known moldable plastic materials. Obviously, other materials and construction techniques could be used to provide a child's perfume maker such as that described herein. Futhermore, various changes might be made in the form of the perfume maker while retaining the inventive concept. Thus, while there has been shown and described a preferred embodiment, it is to be understood that various other adaptations and modifications may be made which will fall within the spirit and scope of the invention.

What is claimed is:

1. A perfume maker comprising a base, a container removably fixed in position relative to the base, means for removably suspending a concentrate of perfume within the container, and means attached to the base for rotating the concentrate of perfume within the container.

2. A perfume maker as claimed in claim 1 wherein the means for suspending the concentrate of perfume includes a holder having a cavity in the lower end thereof for holding the concentrate of perfume, and the means for rotating the concentrate of perfume includes means for rotating the holder.

3. A perfume maker comprising a container; means for suspending a concentrate of perfume within the container, including a holder having a cavity in the lower end thereof for holding the concentrate of perfume; and means for rotating the holder including a base, a cup rotatably mounted to the upper surface of the base, means for fixing the position of the container relative to the base, and means for fixing the holder to the cup.

4. A toy perfume maker as claimed in claim 3 wherein the cup has a gear surface around its lower periphery, and further comprising a gear rotatably mounted to the base to mesh with the gear surface.

5. A toy perfume maker comprising a base, a cup having a gear surface on its lower periphery rotatably supported on the upper surface of the base, a gear meshing with the gear surface rotatably supported on the front surface of the base, a receptacle for a vial fixed to the base and mounted within the cup, a vial constructed to be held in a fixed position by the receptacle, a holder for a perfume concentrate having a portion adapted to fit into the vial and having means fixing the holder to rotate with the cup, and means for withdrawing the holder from the vial.

* * * * *